US009353666B2

(12) United States Patent
Onishi et al.

(10) Patent No.: US 9,353,666 B2
(45) Date of Patent: May 31, 2016

(54) EXHAUST TREATMENT DEVICE OF DIESEL ENGINE

(71) Applicant: KUBOTA Corporation, Osaka-shi, Osaka (JP)

(72) Inventors: Takashi Onishi, Sakai (JP); Hidetaka Morinaga, Sakai (JP); Yoshikazu Takemoto, Sakai (JP); Toshio Nakahira, Sakai (JP); Mitsugu Okuda, Sakai (JP); Keita Naito, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 301 days.

(21) Appl. No.: 14/016,366

(22) Filed: Sep. 3, 2013

(65) Prior Publication Data

US 2014/0072478 A1 Mar. 13, 2014

(30) Foreign Application Priority Data

Sep. 11, 2012 (JP) ..... 2012-199351
Sep. 11, 2012 (JP) ..... 2012-199352

(51) Int. Cl.

| | |
|---|---|
| ***F01N 3/025*** | (2006.01) |
| ***F01N 3/28*** | (2006.01) |
| ***F01N 3/30*** | (2006.01) |
| ***F01N 3/36*** | (2006.01) |
| *F01N 13/00* | (2010.01) |

(52) U.S. Cl.

CPC ..... *F01N 3/2889* (2013.01); *F01N 3/0256* (2013.01); *F01N 3/30* (2013.01); *F01N 3/36* (2013.01); *F01N 3/025* (2013.01); *F01N 13/008* (2013.01); *F01N 2240/14* (2013.01); *F01N 2240/20* (2013.01); *F01N 2240/30* (2013.01); *F01N 2490/16* (2013.01); *F01N 2560/06* (2013.01)

(58) Field of Classification Search

CPC ..... F01N 3/30; F01N 3/36; F01N 3/025; F01N 3/0256; F01N 3/2889; F01N 13/008
USPC ..... 60/295, 300; 422/174, 182
See application file for complete search history.

(56) References Cited

U.S. PATENT DOCUMENTS 7,814,746 B2 * 10/2010 Aketa et al. ..... 422/182

FOREIGN PATENT DOCUMENTS

| | | | |
|---|---|---|---|
| EP | 2474715 | A1 | 7/2012 |
| JP | S60-135612 | A | 7/1985 |
| JP | 2011-214439 | A | 10/2011 |
| JP | 2011-214440 | A | 10/2011 |
| JP | 2011-214441 | A | 10/2011 |

OTHER PUBLICATIONS

Extended European Search Report issued Dec. 9, 2013 in EP Application No. 13250094.3.
Office Action issued Apr. 28, 2015 in JP Application No. 2012-199352.

* cited by examiner

*Primary Examiner* — Jill Warden
*Assistant Examiner* — Joye L Woodard
(74) *Attorney, Agent, or Firm* — Panitch Schwarze Belisario & Nadel LLP

(57) ABSTRACT

An exhaust treatment device of a diesel engine is provided in which combustible gas is burned with oxygen in exhaust, combustion heat increases a temperature of the exhaust, and heat of the exhaust can burn and remove PM accumulating in a DPF. In order to cause a heater for radiating heat at a start of generation of the combustible gas to enter a catalyst inlet portion, and fit a liquid fuel retaining member over a periphery of the heater, a guide plate is provided to a lower face of the liquid fuel retaining member so that the air-fuel mixture moving down in the liquid fuel retaining member flows along an upper face of the guide plate out to a periphery of the guide plate.

8 Claims, 6 Drawing Sheets

1
2
3, 13
4
6
8
9, 16
10
12
14
15
15a
17
20
20a
21
21a
22
22b
22c
23
24
25
27
28
39
40
67
71
72
73
75
76
77
77a
78
B
IIA
IIB
IVB

EXHAUST TREATMENT DEVICE OF DIESEL ENGINE

BACKGROUND OF THE INVENTION

The present invention relates to an exhaust treatment device of a diesel engine and specifically to an exhaust treatment device of a diesel engine, in which heat damage to a combustible gas generating catalyst can be prevented and generation efficiency of the combustible gas can be increased.

Conventionally, there is an exhaust treatment device of a diesel engine, in which a combustible gas generating catalyst chamber is provided in a combustible gas generator, a combustible gas generating catalyst is housed in the combustible gas generating catalyst chamber, an air-fuel mixing chamber is formed at an upper portion of the combustible gas generator, air and liquid fuel are supplied into the air-fuel mixing chamber to thereby form an air-fuel mixture of the air and the liquid fuel in the air-fuel mixing chamber, the air-fuel mixture is supplied from a lower end portion of the air-fuel mixing chamber to a catalyst inlet portion at a center of an upper portion of the combustible gas generating catalyst, the combustible gas generating catalyst generates combustible gas, the combustible gas flows out from a catalyst outlet portion in a lower end portion of the combustible gas generating catalyst, the combustible gas is released from a combustible gas release port into an exhaust passage on an upstream side of a DPF, the combustible gas is burned with oxygen in exhaust, combustion heat increases a temperature of the exhaust, and heat of the exhaust can burn and remove PM accumulating in the DPF (see FIG. 2 in Japanese Patent Application Laid-Open No. 2011-214439).

According to the exhaust treatment device of this type, it is possible to increase the temperature of the exhaust with the combustible gas to burn and remove the PM accumulating in the DPF so that the DPF can be regenerated and reused.

However, this related art has a problem because a lower face of a liquid fuel retaining member is brought into contact with the combustible gas generating catalyst in order to cause a heater for radiating heat at a start of generation of the combustible gas to enter the catalyst inlet portion and fit the liquid fuel retaining member over a periphery of the heater.

There is a fear of heat damage to the combustible gas generating catalyst.

Because the lower face of the liquid fuel retaining member is brought into contact with the combustible gas generating catalyst, the air-fuel mixture moving down in the liquid fuel retaining member and flowing out from the lower face of the liquid fuel retaining member is concentrated into a central portion of the combustible gas generating catalyst immediately below the liquid fuel retaining member, the central portion of the gas generating catalyst gets overheated with catalytic reaction heat, and the heat damage to the combustible gas generating catalyst may occur.

Because the lower face of the liquid fuel retaining member is brought into contact with the combustible gas generating catalyst, the air-fuel mixture moving down in the liquid fuel retaining member and flowing out from the lower face of the liquid fuel retaining member is concentrated into the central portion of the combustible gas generating catalyst immediately below the liquid fuel retaining member, the air-fuel mixture is less likely to be supplied into a large capacity portion on an outer periphery side of the combustible gas generating catalyst, the large capacity portion is not sufficiently used for generation of the combustible gas, and the generation efficiency of the combustible gas is low.

BRIEF SUMMARY OF THE INVENTION

An object of the present invention is to provide an exhaust treatment device of a diesel engine, in which heat damage to a combustible gas generating catalyst can be prevented and generation efficiency of the combustible gas can be increased.

As illustrated as an example in FIG. 1A, an exhaust treatment device of a diesel engine, in which a combustible gas generating catalyst chamber (21) is provided in a combustible gas generator (1), a combustible gas generating catalyst (22) is housed in the combustible gas generating catalyst chamber (21), an air-fuel mixing chamber (24) is formed at an upper portion of the combustible gas generator (1), air (25) and liquid fuel (26) are supplied into the air-fuel mixing chamber (24) to thereby form an air-fuel mixture (27) of the air (25) and the liquid fuel (26) illustrated in FIG. 3 in the air-fuel mixing chamber (24), the air-fuel mixture (27) is supplied from a lower end portion of the air-fuel mixing chamber (24) to a catalyst inlet portion (75) at a center of an upper portion of the combustible gas generating catalyst (22), the combustible gas generating catalyst (22) generates combustible gas (2), the combustible gas (2) flows out from a catalyst outlet portion (76) in a lower end portion of the combustible gas generating catalyst (22), as illustrated as an example in FIG. 3, the combustible gas (2) is released from a combustible gas release port (3) into an exhaust passage (4) on an upstream side of a DPF (7), the combustible gas (2) is burned with oxygen in exhaust (6), combustion heat increases a temperature of the exhaust (6), and heat of the exhaust (6) can burn and remove PM accumulating in the DPF (7), wherein, as illustrated as an example in FIG. 1A, in order to cause a heater (67) for radiating heat at a start of generation of the combustible gas to enter a catalyst inlet portion (75), and fit a liquid fuel retaining member (71) over a periphery of the heater (67), a guide plate (73) is provided to a lower face of the liquid fuel retaining member (71) so that the air-fuel mixture (27) moving down in the liquid fuel retaining member (71) flows along an upper face of the guide plate (73) out to a periphery of the guide plate (73).

It is therefore possible to prevent heat damage to the combustible gas generating catalyst.

As illustrated as an example in FIG. 1A, the guide plate (73) is provided to the lower face of the liquid fuel retaining member (71) so that the air-fuel mixture (27) moving down in the liquid fuel retaining member (71) flows along the upper face of the guide plate (73) out to the periphery of the guide plate (73). Therefore, the air-fuel mixture (27) is widely dispersed around the guide plate (73) and overheating due to concentration of the catalytic reaction heat is less likely to occur, which prevents the heat damage to the combustible gas generating catalyst (22).

It is also possible to increase generation efficiency of the combustible gas.

As shown as an example in FIG. 1A, the guide plate (73) is provided to the lower face of the liquid fuel retaining member (71) so that the air-fuel mixture (27) moving down in the liquid fuel retaining member (71) flows along the upper face of the guide plate (73) out to the periphery of the guide plate (73). Therefore, the air-fuel mixture (27) is smoothly supplied into a large-volume portion on an outer periphery side of the combustible gas generating catalyst (22) and the large-volume portion is sufficiently used for generation of the combustible gas (2), which increases the generation efficiency of the combustible gas (2).

It is possible to smoothly start the generation of the combustible gas.

As shown as an example in FIG. 1A, the heater (67) for radiating heat at the start of generation of the combustible gas enters the catalyst inlet portion (75), and the liquid fuel retaining member (71) is fitted over the periphery of the heater (67). Therefore, heat of the heater (67) is intensively transferred to the liquid fuel (26) temporarily retained in the liquid fuel retaining member (71) to increase a temperature of the liquid fuel (26) early and the combustible gas generating catalyst (22) can smoothly start the generation of the combustible gas (2).

It is possible to accurately detect a temperature of the combustible gas generating catalyst with a catalyst temperature detecting device.

As shown as an example in FIG. 1A, a temperature detecting portion (20*a*) of the catalyst temperature detecting device (20) is disposed immediately below the guide plate (73). Therefore, the catalyst temperature detecting device (20) is positioned at a central portion surrounded with the large-volume portion on the outer periphery side of the combustible gas generating catalyst (22) and it is possible to accurately detect the temperature of the combustible gas generating catalyst (22) with the catalyst temperature detecting device (20).

It is possible to easily impregnate catalyst supports including their inner portions with the catalyst component.

As shown as an example in FIGS. 1A and 2B, the combustible gas generating catalyst (22) is catalyst supports (39), (39) supporting a catalyst component, the catalyst supports (39), (39) are formed by two parts divided along vertical division faces (40) along a central axis (22*c*) of the combustible gas generating catalyst (22). Therefore, as compared with a catalyst support (39) formed by a single part, surface areas of the catalyst supports (39), (39) are larger by the division faces (40) and it is possible to easily impregnate the catalyst supports (39), (39) including their inner portions with the catalyst component.

It is possible to easily mount the liquid fuel retaining member and the guide plate in the combustible gas generating catalyst.

As shown as an example in FIG. 1A, the liquid fuel retaining member (71) and the guide plate (73) are sandwiched and fixed between the two parts forming the catalyst supports (39), (39). Therefore, it is possible to easily mount the liquid fuel retaining member (71) and the guide plate (73) in the combustible gas generating catalyst (22).

It is possible to reduce manufacturing cost of the combustible gas generating catalyst.

As shown as an example in FIG. 2B, the catalyst supports (39), (39) formed by the two parts are in the same shapes. Therefore, the catalyst supports (39), (39) can be formed by using the two parts molded in the same molding die into the same shapes, which reduces the manufacturing cost of the combustible gas generating catalyst (22).

It is possible to prevent heat damage to the combustible gas generating catalyst.

As shown as an example in FIG. 2A, in order to interpose a heat insulating material (74) between an inner peripheral face (21*a*) of the combustible gas generating catalyst chamber (21) and an outer peripheral face (22*a*) of the combustible gas generating catalyst (22), the heat insulating material (74) is not interposed between upper end edge portions (21*b*) and (22*b*) of the inner peripheral face (21*a*) and the outer peripheral face (22*a*) and the upper end edge portions (21*b*) and (22*b*) are brought in close contact with each other so that catalytic reaction heat is radiated from the upper end edge portion (22*b*) of the outer peripheral face (22*a*) of the combustible gas generating catalyst (22) to the upper end edge portion (21*b*) of the inner peripheral face (21*a*) of the combustible gas generating catalyst chamber (21). Therefore, excessive catalytic reaction heat generated in a vicinity of the upper end edge portion (22*b*) of the outer peripheral face (22*a*) of the combustible gas generating catalyst (22) is radiated to a chamber wall of the combustible gas generating catalyst chamber (21), which suppresses overheating of the vicinity of the upper end edge portion (22*b*) of the outer peripheral face (22*a*) of the combustible gas generating catalyst (22) and prevents the heat damage to the combustible gas generating catalyst (22).

It is possible to increase generation efficiency of the combustible gas.

As shown as an example in FIG. 2A, the heat insulating material (74) is interposed between the inner peripheral face (21*a*) of the combustible gas generating catalyst chamber (21) and the outer peripheral face (22*a*) of the combustible gas generating catalyst (22). Therefore, the catalytic reaction heat of the combustible gas generating catalyst (22) is less likely to be radiated from a portion of the outer peripheral face (22*a*) of the combustible gas generating catalyst (22) other than the upper end edge portion (22*b*) to a chamber wall of the combustible gas generating catalyst chamber (21) and an activation temperature of the combustible gas generating catalyst (22) is maintained, which increases the generation efficiency of the combustible gas (2).

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIGS. 1A to 1C are drawings for explaining an exhaust treatment device of a diesel engine according to an embodiment of the present invention, wherein FIG. 1A is a vertical sectional view of a combustible gas generator and peripheral parts, FIG. 1B is a sectional view along line B-B in FIG. 1A, and FIG. 1C is a vertical sectional view of a variation of a combustible gas nozzle;

DETAILED DESCRIPTION OF THE INVENTION

FIGS. 1 to 6 are drawings for explaining an exhaust treatment device of a diesel engine according to an embodiment of the present invention.

A general outline of the exhaust treatment device is as follows.

Figures 1A, 1B, 1C:
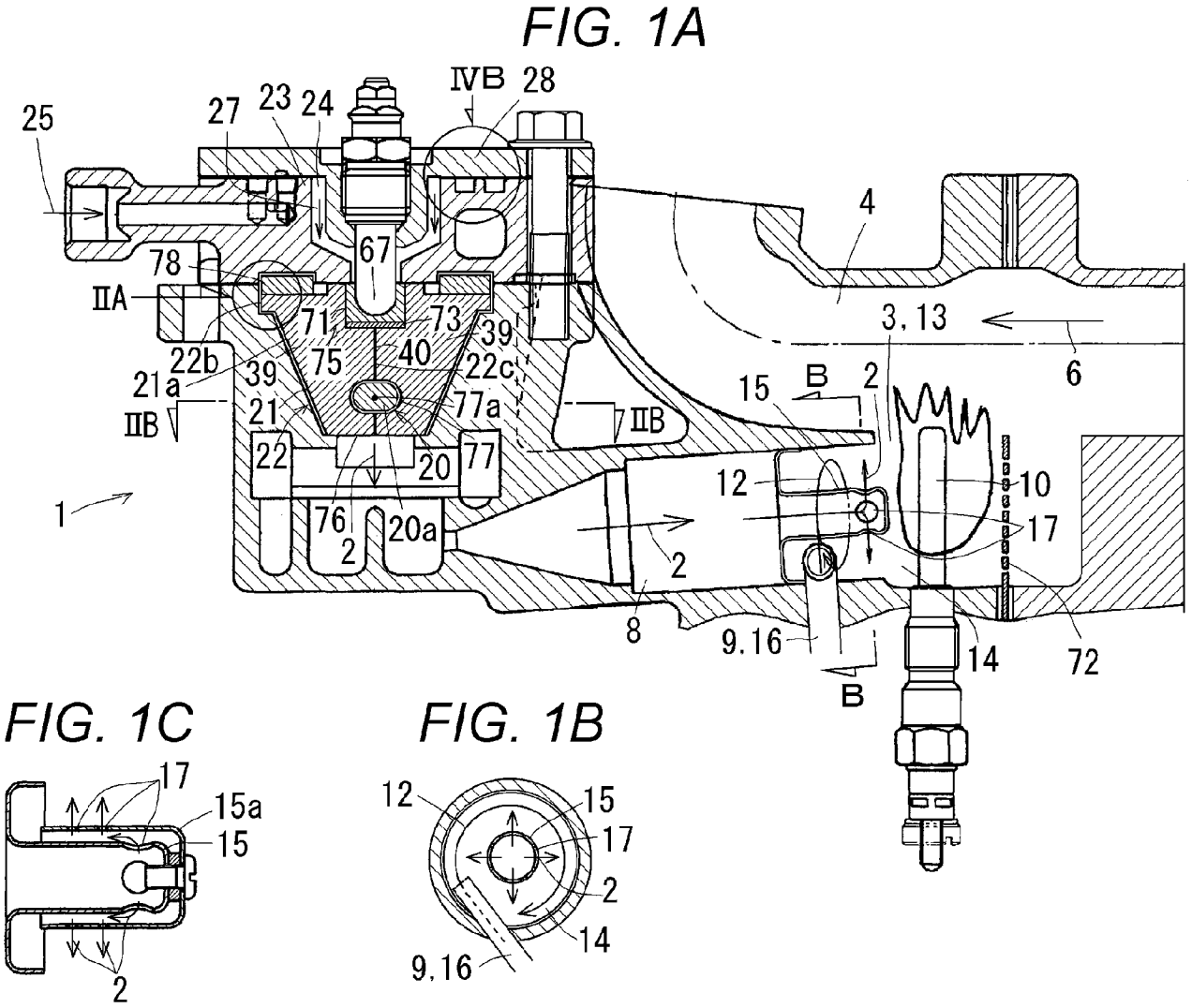
Figure 3:
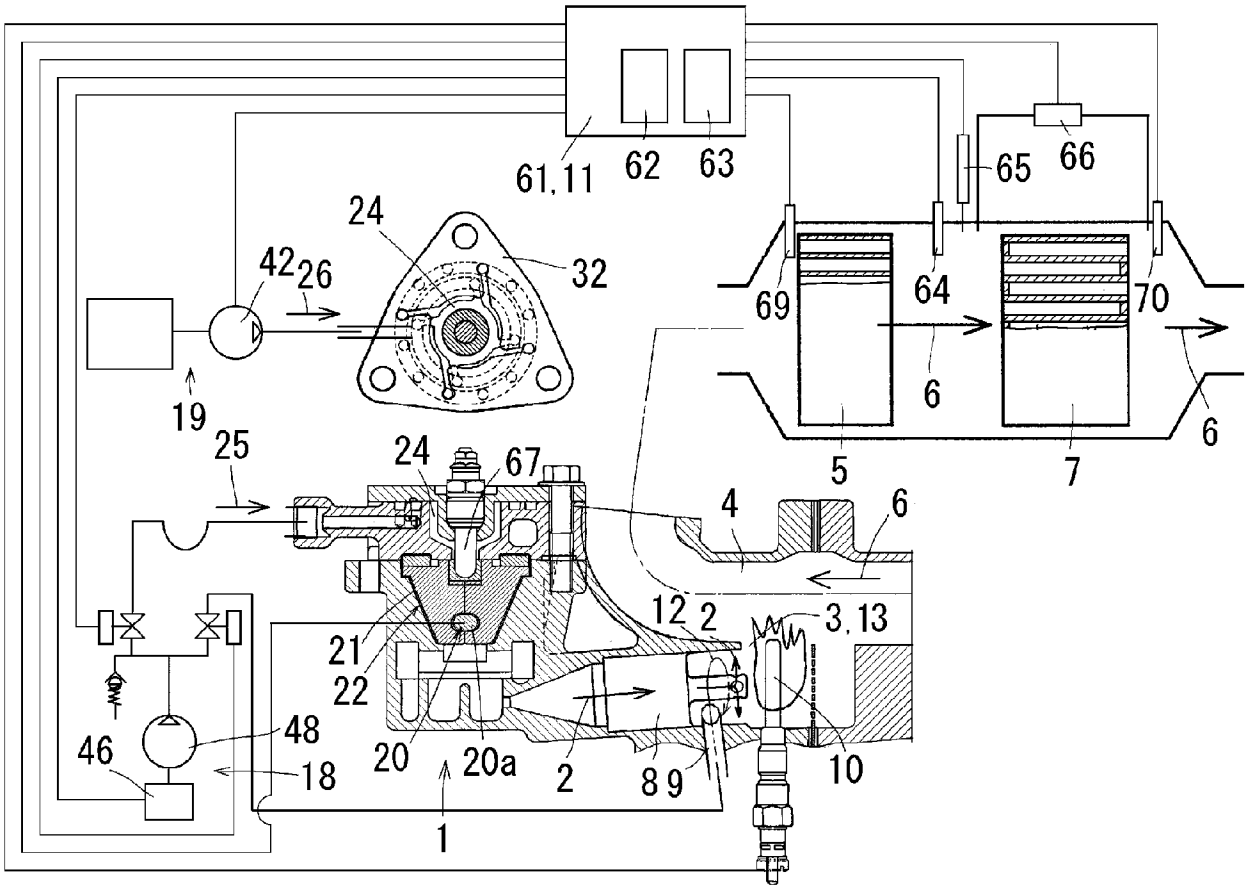
FIG. 3 is a schematic diagram of the exhaust treatment device of the diesel engine according to the embodiment of the invention.

As shown in FIG. 1A, a combustible gas generating catalyst chamber (21) is provided in a combustible gas generator (1), a combustible gas generating catalyst (22) is housed in the combustible gas generating catalyst chamber (21), an air-fuel mixing chamber (24) is formed at an upper portion of the combustible gas generator (1), air (25) and liquid fuel (26) are supplied into the air-fuel mixing chamber (24) to thereby form an air-fuel mixture (27) of the air (25) and the liquid fuel (26) shown in FIG. 3 in the air-fuel mixing chamber (24), the air-fuel mixture (27) is supplied from a lower end portion of the air-fuel mixing chamber (24) into a catalyst inlet portion (75) at a center of an upper portion of the combustible gas generating catalyst (22), combustible gas (2) is generated by the combustible gas generating catalyst (22), and the combustible gas (2) flows out from a catalyst outlet portion (76) in a lower end portion of the combustible gas generating catalyst (22).

The combustible gas generating catalyst (22) is an oxidation catalyst. As the liquid fuel (26), light oil which is fuel for a diesel engine is used. The combustible gas (2) is a mixture of the air (25), the liquid fuel (26), and thermally decomposed components of the liquid fuel (26) and is obtained when a part of the liquid fuel (26) is oxidized by the combustible gas generating catalyst (22) and remaining liquid fuel (26) is vaporized or thermally decomposed with heat of the oxidation. The catalyst outlet portion (76) is in a central portion of the lower end of the combustible gas generating catalyst (22).

As shown in FIG. 3, the combustible gas (2) is released into an exhaust passage (4) from a combustible gas release port (3) on an upstream side of a DPF (7), the combustible gas (2) is burned with oxygen in exhaust (6), heat of the combustion increases temperature of the exhaust (6), and heat of the exhaust (6) burns and removes PM accumulating in the DPF (7).

Therefore, even when the temperature of the exhaust (6) is low, it is possible to increase the temperature of the exhaust (6) with the combustible gas (2) to burn and remove the PM accumulating in the DPF (7) so that the DPF (7) can be regenerated and reused.

A combustion catalyst (5) is disposed on the upstream side of the DPF (7) and the combustible gas (2) is catalytically burned by the combustion catalyst (5) with the oxygen in the exhaust (6). The combustion catalyst (5) is a DOC.

DPF is an abbreviation for diesel particulate filter. PM is an abbreviation for particulate matter and DOC is an abbreviation for diesel oxidation catalyst.

Figure 2A:
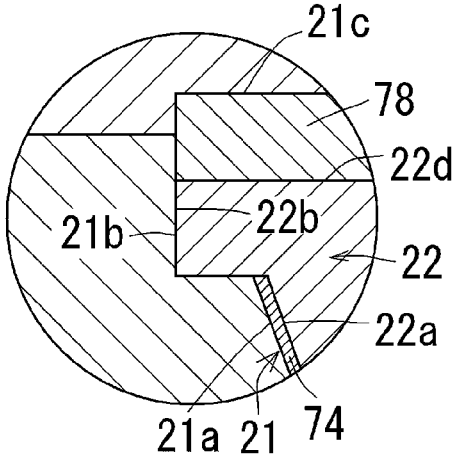
FIGS. 2A is an enlarged view of portion IIA in FIG. 1A

As shown in FIG. 2A, in order to interpose a heat insulating material (74) between an inner peripheral face (21*a*) of the combustible gas generating catalyst chamber (21) and an outer peripheral face (22*a*) of the combustible gas generating catalyst (22), the heat insulating material (74) is not interposed between upper end edge portions (21*b*) and (22*b*) of the inner peripheral face (21*a*) and the outer peripheral face (22*a*) and the upper end edge portions (21*b*) and (22*b*) are brought in close contact with each other so that catalytic reaction heat is radiated from the upper end edge portion (22*b*) of outer peripheral face (22*a*) of the combustible gas generating catalyst (22) to the upper end edge portion (21*b*) of the inner peripheral face (21*a*) of the combustible gas generating catalyst chamber (21).

In this way, the excessive catalytic reaction heat generated in a vicinity of the upper end edge portion (22*b*) of the outer peripheral face (22*a*) of the combustible gas generating catalyst (22) is radiated to a chamber wall of the combustible gas generating catalyst chamber (21), which suppresses overheating of the vicinity of the upper end edge portion (22*b*) of the outer peripheral face (22*a*) of the combustible gas generating catalyst (22) to prevent heat damage to the combustible gas generating catalyst (22).

The catalytic reaction heat of the combustible gas generating catalyst (22) is less likely to be radiated from a portion of the outer peripheral face (22*a*) of the combustible gas generating catalyst (22) other than the upper end edge portion (22*b*) to the chamber wall of the combustible gas generating catalyst chamber (21) and the combustible gas generating catalyst (22) is kept activated, which increases generation efficiency of the combustible gas (2).

A heat insulating material (78) is also interposed between a ceiling face (21*c*) of the combustible gas generating catalyst chamber (21) and an upper face (22*d*) of the combustible gas generating catalyst (22). The respective heat insulating materials (74) and (78) are mats made of alumina fibers and also function as cushion materials.

As shown in FIG. 1A, in order to cause a heater (67) for radiating heat at the start of generation of the combustible gas to enter the catalyst inlet portion (75), and fit a liquid fuel retaining member (71) over a periphery of the heater (67), a guide plate (73) is provided to a lower face of the liquid fuel retaining member (71) so that the air-fuel mixture (27) moving down in the liquid fuel retaining member (71) flows along an upper face of the guide plate (73) out to a periphery of the guide plate (73).

The heater (67) is an electric glow plug.

The liquid fuel retaining member (71) is a mat made of alumina fibers and supporting a rhodium catalytic component on its surface. The liquid fuel retaining member (71) has higher liquid fuel retaining performance than the combustible gas generating catalyst (22).

The guide plate (73) is formed by a flat plate made of stainless steel.

As shown in FIG. 3, in order to communicate an air supply device (18) and a liquid fuel supply device (19) with the air-fuel mixing chamber (24), insert a temperature detecting portion (20*a*) of a catalyst temperature detecting device (20) into the combustible gas generating catalyst (22), coordinate the catalyst temperature detecting device (20) with the air supply device (18) and the liquid fuel supply device (19) through a control device (11), and use the control device (11) to cause the air supply device (18) and the liquid fuel supply device (19) to adjust amounts of the air (25) and the liquid fuel (26) to be supplied into the air-fuel mixing chamber (24) based on a temperature of the combustible gas generating catalyst (22) detected by the catalyst temperature detecting device (20) to thereby adjust the temperature of the combustible gas generating catalyst (22), as shown in FIG. 1A, the temperature detecting portion (20*a*) of the catalyst temperature detecting device (20) is disposed immediately below the guide plate (73).

The catalyst temperature detecting device (20) is a thermistor.

Figure 2B:
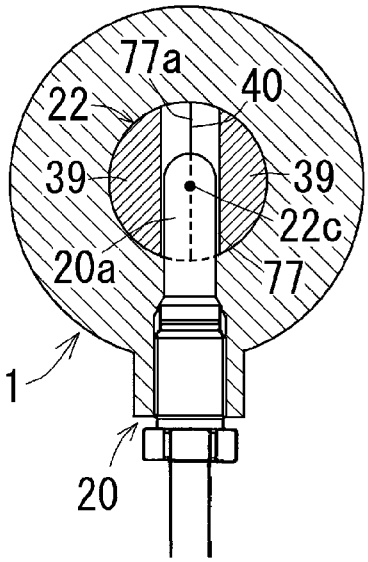
FIG. 2B is a sectional view along line IIB-IIB in FIG. 1A.

As shown in FIGS. 1A and 2B, the combustible gas generating catalyst (22) is formed by catalyst supports (39), (39) supporting the catalyst component, the catalyst supports (39), (39) are formed by two parts divided along vertical division faces (40) along a central axis (22*c*) of the combustible gas generating catalyst (22), and the liquid fuel retaining member (71) and the guide plate (73) are sandwiched and fixed between the two parts forming the catalyst supports (39), (39).

The catalyst supports (39), (39) are formed into halves of a truncated cone by woven iron-chromium wire and the rhodium catalyst component is supported on the catalyst supports (39), (39).

As shown in FIG. 2B, an insertion hole (77) into which the temperature detecting portion (20*a*) of the catalyst temperature detecting device (20) is inserted is formed to pass through the combustible gas generating catalyst (22) and a central axis (77*a*) of the insertion hole (77) extends to be orthogonal to the central axis (22*c*) of the combustible gas generating catalyst (22) and along a direction parallel to the division faces (40) so that the catalyst supports (39), (39) formed by the two parts are in the same shapes.

As shown in FIG. 1A, the combustible gas generating catalyst chamber (21) and the combustible gas generating catalyst (22) are tapered downward and the combustible gas generating catalyst (22) is fitted in the combustible gas generating catalyst chamber (21).

In this way, a lower portion of the combustible gas generating catalyst (22) has a relatively small sectional area in a radial direction, the liquid fuel (26) passing through the lower portion of the combustible gas generating catalyst (22) passes uniformly through an outer peripheral portion near a central portion and the central portion when inclined, non-uniform temperature distribution of the combustible gas generating catalyst (22) due to the catalytic reaction heat is corrected, and the heat damage to the combustible gas generating catalyst (22) can be suppressed.

As shown in FIG. 3, a combustible gas supply passage (8) communicates with the exhaust passage (4) on an upstream side of the combustion catalyst (5), a secondary air supply device (9) and an ignition device (10) are provided in the combustible gas supply passage (8), and the secondary air supply device (9) and the ignition device (10) are coordinated with the control device (11). The ignition device (10) is an electric glow plug. A reference numeral (72) in the drawing designates a flame holding screen formed by forming a large number of holes in a plate member and suppresses extinction of combustion fire due to the exhaust (6).

As shown in FIG. 3, when an exhaust temperature is lower than a predetermined temperature, the control device (11) causes the secondary air supply device (9) to supply secondary air (12) to the combustible gas (2) and causes the ignition device (10) to ignite the combustible gas (2) to cause fire combustion of the combustible gas (2), and heat of the fire combustion increases the temperature of the exhaust (6) in the exhaust passage (4).

As a result, even when the exhaust temperature is inherently lower than an activation temperature of the combustion catalyst (5), e.g., immediately after engine starting or during light load operation, the heat of the fire combustion of the combustible gas (2) can increase the temperature of the exhaust (6) so that the exhaust temperature reaches the activation temperature of the combustion catalyst (5). Therefore, it is possible to burn the PM accumulating in the DPF (7) or activate the exhaust purification catalyst even immediately after the engine starting or during the light load operation.

As shown in FIG. 1A, the exhaust passage (4) and the combustible gas supply passage (8) are provided side by side, a heat radiation opening (13) is formed at a boundary between the exhaust passage (4) and the combustible gas supply passage (8) on a downstream side of the combustible gas supply passage (8), the heat radiation opening (13) connects the exhaust passage (4) and the combustible gas supply passage (8), and the ignition device (10) disposed on the downstream side of the combustible gas supply passage (8) faces the heat radiation opening (13).

As a result, the combustible gas supply passage (8) and the ignition device (10) do not obstruct a flow of the exhaust (6) in the exhaust passage (4) and do not increase exhaust pressure. Moreover, the combustion fire of the combustible gas (2) directly increases the temperature of the exhaust (6) and temperature increasing efficiency of the exhaust (6) is high.

As shown in FIG. 1A, the combustible gas supply passage (8) is provided below the exhaust passage (4) and the heat radiation opening (13) is formed on a lower side of a peripheral face of the exhaust passage (4). As a result, heat of the combustion fire of the combustible gas (2) rises into the exhaust passage (4) to increase the temperature of the exhaust (6) in the exhaust passage (4), which further increases the temperature increasing efficiency of the exhaust (6).

As shown in FIGS. 1A and 1B, a mixing chamber (14) of the combustible gas (2) and the secondary air (12) is formed along the combustible gas supply passage (8) on an upstream side of the ignition device (10), a combustible gas nozzle (15) and an air supply pipe (16) are provided in the mixing chamber (14), the combustible gas nozzle (15) is disposed at a central portion of the mixing chamber (14) in an orientation along a direction in which the mixing chamber (14) is formed, a plurality of combustible gas outlets (17) are formed in a peripheral face of the combustible gas nozzle (15), the air supply pipe (16) is disposed at an inner peripheral face portion of the mixing chamber (14) in an orientation along a circumferential direction of the inner peripheral face of the mixing chamber (14), and the secondary air (12) supplied from the air supply pipe (16) is caused to swirl along the inner peripheral face of the mixing chamber (14) around the combustible gas nozzle (15).

The combustible gas (2) supplied in radial directions of the mixing chamber (14) from the combustible gas outlets (17) is mixed into the swirling secondary air (12). As a result, satisfactory mixing performance of the combustible gas (2) and the secondary air (12) can be achieved and a large heat radiation amount can be obtained by ignition of the combustible gas (2).

As shown in FIG. 1C, the combustible gas nozzle (15) may be covered with a cap (15*a*) and combustible gas outlets (17) may be formed in a circumferential direction in a peripheral wall of the cap (15*a*) to supply the combustible gas (2) flowing out into the cap (15*a*) from the combustible gas nozzle (15) in the radial direction of the mixing chamber (14) from the combustible gas outlets (17) of the cap (15*a*).

As shown in FIG. 3, in order to supply the liquid fuel (26) and the air (25) into the combustible gas generator (1) and generate the combustible gas (2) by the combustible gas generating catalyst (22), if the temperature of the combustible gas generating catalyst (22) is lower than a predetermined temperature, the control device (11) causes the secondary air supply device (9) to supply the secondary air (12) to the combustible gas (2) and causes the ignition device (10) to ignite the combustible gas (2) to cause the fire combustion of the combustible gas (2) and the heat of the fire combustion vaporizes the liquid component flowing out of the combustible gas generator (1). In this way, the liquid component flowing out of the combustible gas generator (1) does not adhere to an inside of the exhaust passage (4), which prevents generation of white smoke at the time of the engine starting.

As shown in FIG. 1A, in order to provide the combustible gas generating catalyst chamber (21) in the combustible gas generator (1), house the combustible gas generating catalyst (22) in the combustible gas generating catalyst chamber (21), dispose an annular wall (23) at an upper end portion of the combustible gas generating catalyst chamber (21), form the air-fuel mixing chamber (24) inside the annular wall (23), supply the air (25) and the liquid fuel (26) into the air-fuel mixing chamber (24) to thereby form the air-fuel mixture gas (27) in the air-fuel mixing chamber (24), supply the air-fuel mixture gas (27) to the combustible gas generating catalyst (22), and generate the combustible gas (2) by the combustible gas generating catalyst (22), the exhaust treatment device is configured as follows.

Figure 4A:
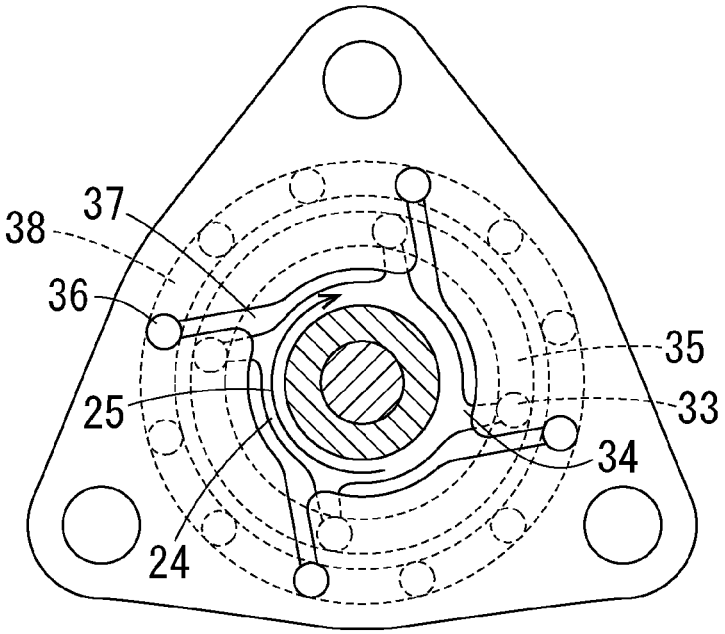
FIG. 4A is a plan view in which a double gasket used in the exhaust treatment device in FIGS. 1A to 1C is placed on a lid placing face and FIG. 4B is an enlarged view of portion IVB in FIG. 1A.
Figure 4B:
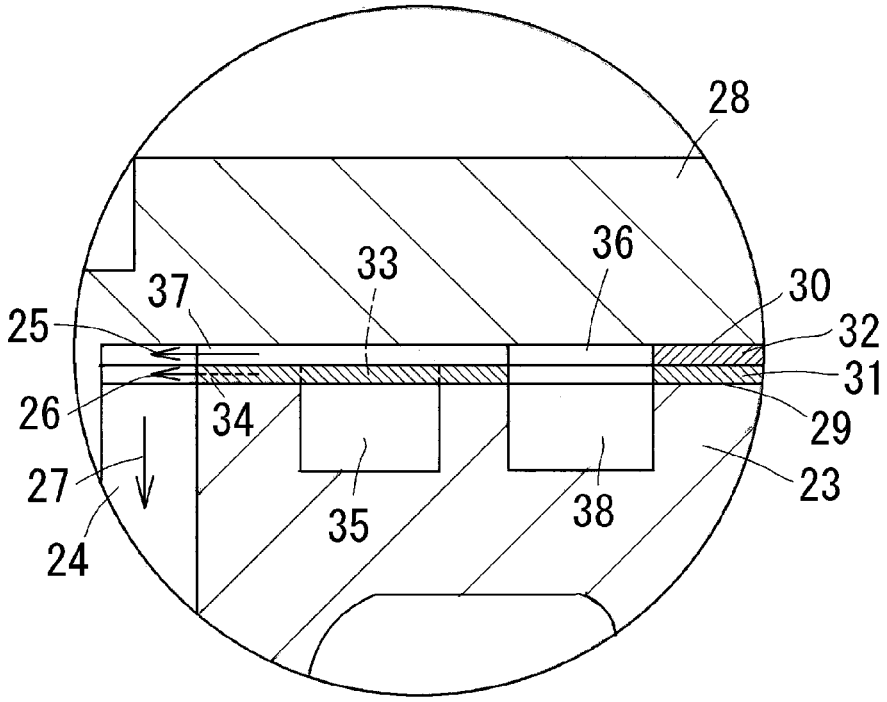
Figure 5A:
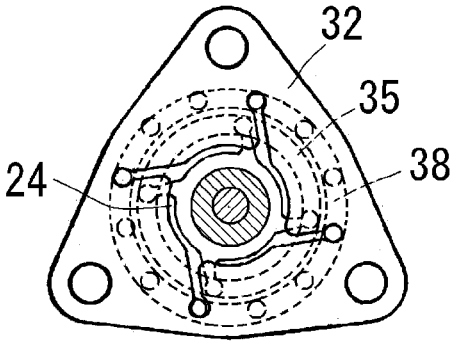
FIG. 5A is a miniature of FIG. 4A.
Figure 5B:
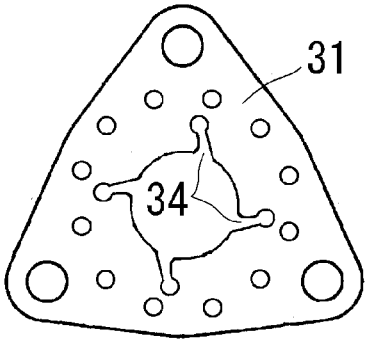
FIG. 5B is a plan view of a lower gasket having a liquid fuel outlet.
Figure 5C:
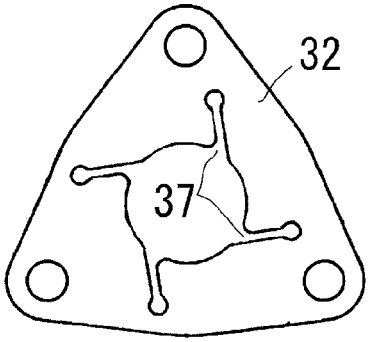
FIG. 5C is a plan view of an upper gasket having an air outlet.

As shown in FIG. 4B, a lid (28) is disposed at a starting end portion of the annular wall (23), an annular lid placing face (29) is provided to the starting end portion of the annular wall (23), a placed face (30) is provided to the lid (28), and the placed face (30) of the lid (28) is placed and fixed onto the lid placing face (29) of the annular wall (23) with annular gaskets (31) and (32) interposed therebetween.

As shown in FIG. 4A, a plurality of liquid fuel inlets (33) and a plurality of liquid fuel outlets (34) are provided at predetermined intervals in a circumferential direction of the gasket (31) and the liquid fuel outlets (34) are lead out from the respective liquid fuel inlets (33) toward an inner side of the gasket (31).

As shown as an example in FIG. 4B, a liquid fuel guide groove (35) extending along a circumferential direction of the lid placing face (29) of the annular wall (23) or the placed face (30) of the lid (28) is formed to be recessed and the respective liquid fuel inlets (33) communicate with an opening of the liquid fuel guide groove (35) so that the liquid fuel (26) supplied into the liquid fuel guide groove (35) flows out into the air-fuel mixing chamber (24) from the liquid fuel outlets (34) through the respective liquid fuel inlets (33).

In this way, it is possible to make machining of the annular wall (23) easy as compared with an annular wall (23) in which a liquid fuel guide passage and liquid fuel outlets are formed.

As shown in FIG. 4A, in order to swirl the air (25) in the air-fuel mixing chamber (24), the liquid fuel outlets (34) are oriented toward a downstream side of an air swirling direction in the air-fuel mixing chamber (24). As a result, mixing of the air (25) and the liquid fuel (26) in the air-fuel mixing chamber (24) becomes uniform.

As shown in FIG. 4A, a plurality of air inlets (36) and a plurality of air outlets (37) are provided at predetermined intervals in a circumferential direction of the gasket (32), the air outlets (37) are lead out from the respective air inlets (36) toward an inner side of the gasket (32), an air guide groove (38) extending along a circumferential direction of the lid placing face (29) of the annular wall (23) or the placed face (30) of the lid (28) is formed to be recessed as shown as an example in FIG. 4B, and the respective air inlets (36) communicate with an opening of the air guide groove (38) so that the air (25) supplied into the air guide groove (38) flows out into the air-fuel mixing chamber (24) from the air outlets (37) through the respective air inlets (36).

In this way, it is possible to make machining of the annular wall (23) easy as compared with an annular wall (23) in which an air guide passage and air outlets are formed.

As shown in FIG. 4A, in order to swirl the air (25) in the air-fuel mixing chamber (24), the air outlets (37) are oriented toward the downstream side of the air swirling direction in the air-fuel mixing chamber (24). As a result, it is possible to easily swirl the air (25) in the air-fuel mixing chamber (24).

As shown in FIG. 4B, the four liquid fuel outlets (34) are disposed at equal intervals in the circumferential direction of the gasket (31).

Control of the regeneration of the DPF is carried out as follows.

An engine ECU (61) shown in FIG. 3 includes a PM accumulation amount estimating device (62) and a PM regeneration control device (63). The engine ECU is an abbreviation for an engine electronic control unit.

The PM accumulation amount estimating device (62) is a predetermined arithmetic section of the engine ECU (61) and estimates a PM accumulation amount from map data obtained experimentally in advance based on an engine load, an engine speed, an exhaust temperature detected by a DPF upstream exhaust temperature sensor (64), exhaust pressure on an upstream side of the DPF (7) detected by a DPF upstream exhaust pressure sensor (65), and a pressure difference between the upstream side and a downstream side of the DPF (7) detected by a differential pressure sensor (66).

If a PM accumulation amount estimate obtained by the PM accumulation amount estimating device (62) reaches a predetermined regeneration start value, the PM regeneration control device (63) causes the heater (67) to generate heat and drives a liquid fuel pump (42) and a motor (46) of a blower (48). As a result, the liquid fuel (26) and the air (25) are supplied into the air-fuel mixing chamber (24) and the combustible gas (2) is generated in the combustible gas generating catalyst (22). A periphery of the heater (67) is surrounded with the liquid fuel retaining member (71) which can retain the liquid fuel, heat of the heater (67) is intensively supplied to the liquid fuel retained by the liquid fuel retaining member (71), and generation of the combustible gas (2) is started swiftly.

The heater (67) is caused to generate heat for a predetermined time in an early stage of starting of generation of the combustible gas (2). When the generation of the combustible gas (2) is started, the temperature of the combustible gas generating catalyst (22) increases due to an exothermic reaction and therefore the heat generation by the heater (67) is stopped by a timer when a predetermined time has elapsed since the start of the generation of the combustible gas (2).

A temperature sensor (68) of the combustible gas generating catalyst (22) and an inlet temperature sensor (69) of the combustion catalyst (5) are coordinated with the PM regeneration control device (63) and the ignition device (10) ignites the combustible gas (2) when the temperature of the combustible gas generating catalyst (22) and an inlet temperature of the combustion catalyst (5) are lower than predetermined temperatures.

An outlet temperature sensor (70) of the DPF (7) is coordinated with the PM regeneration control device (63) and regeneration is stopped urgently when the outlet temperature of the DPF (7) is abnormally high.

A process of the DPF regeneration is as follows.

Figure 6:
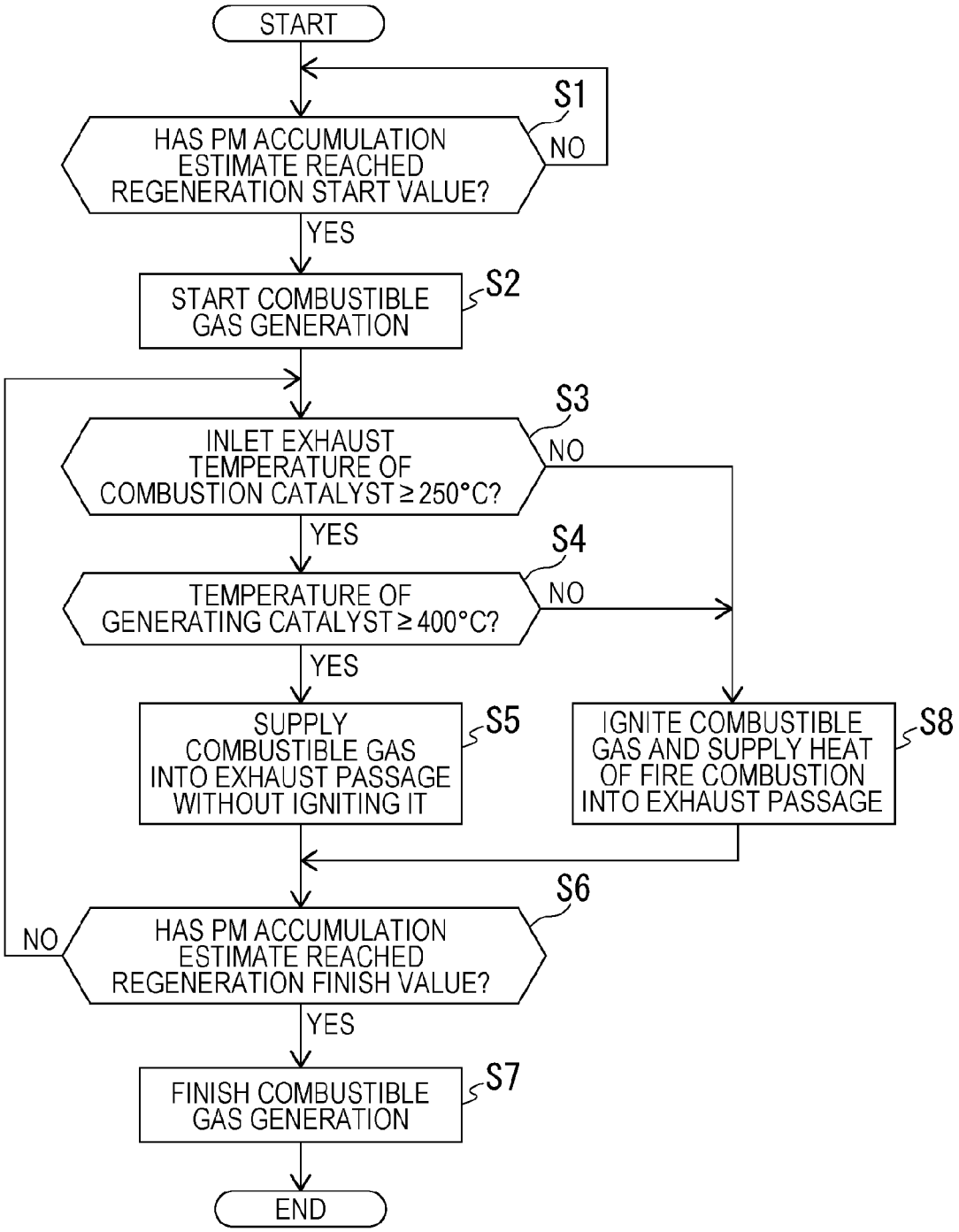
FIG. 6 is a flowchart of regeneration of a DPF by the exhaust treatment device in FIG. 1.

As shown in FIG. 6, whether the PM accumulation estimate has reached the regeneration start value is determined in step (S1). If the determination result is YES, the generation of the combustible gas is started in step (S2), and whether the inlet exhaust temperature of the combustion catalyst (5) is not lower than 250° C. is determined in step (S3). If the determination result is YES, whether the temperature of the combustible gas generating catalyst (22) is not lower than 400° C. is determined in step (S4). If the determination result is YES, the combustible gas (2) is not ignited in step (S5), the combustible gas (2) is supplied into the exhaust passage (4), and whether the PM accumulation estimate has reached a regeneration finish value is determined in step (S6). If the determination result is YES, the generation of the combustible gas is finished in step (S7) and the regeneration of the DPF ends.

If the determination result in step (S6) is NO, the process returns to step (S3). If the determination result in step (S3) or step (S4) is NO, the combustible gas (2) is ignited in step (S8) and heat of fire combustion is supplied into the exhaust passage (4) in both the cases.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claim is:

1. An exhaust treatment device of a diesel engine comprising:

a combustible gas generator, a combustible gas generating catalyst chamber provided in the combustible gas generator, a combustible gas generating catalyst for generating combustible gas, housed in the combustible gas generating catalyst chamber and having a catalyst inlet portion at a central upper portion thereof and a catalyst outlet portion in a lower end portion thereof, a heater in the catalyst inlet portion of the combustible gas generating catalyst, a liquid fuel retaining member fitted over a periphery of the heater, and a guide plate positioned at a lower face of the liquid fuel retaining member, an air-fuel mixing chamber formed at an upper portion of the combustible gas generator, air and liquid fuel being supplied into the air-fuel mixing chamber to form an air-fuel mixture, a combustible gas release port, an exhaust passage, and a diesel particulate filter (DPF), wherein:

the air-fuel mixture is supplied from a lower end portion of the air-fuel mixing chamber to the combustible gas generating catalyst through the catalyst inlet portion, and flows down the liquid fuel retaining member and along an upper face of the guide plate to a periphery of the guide plate, the heater radiates heat to generate combustible gas from the air-fuel mixture by the combustible gas generating catalyst, the generated combustible gas flows out of the combustible gas generating catalyst through the catalyst outlet portion, and is released from the combustible gas release port into the exhaust passage on an upstream side of the DPF, and the combustible gas is burned with oxygen in exhaust located in the exhaust passage, which creates combustion heat thereby increasing a temperature of the exhaust, and heat of the exhaust burning and removing particulate matter (PM) accumulating in the DPF.

2. The exhaust treatment device of the diesel engine according to claim 1, further comprising:

an air supply device, a catalyst temperature detecting device having a temperature detecting portion positioned within the combustible gas generating catalyst below the guide plate, and a control device in operative communication with the catalyst temperature detecting device, the air supply device and the liquid fuel supply device, and configured to direct the air supply device and the liquid fuel supply device to adjust respective amounts of the air and the liquid fuel to be supplied into the air-fuel mixing chamber according to a temperature of the combustible gas generating catalyst detected by the catalyst temperature detecting device and thereby adjust the temperature of the combustible gas generating catalyst.

3. The exhaust treatment device of the diesel engine according to claim 2, further comprising a heat insulating material interposed between an inner peripheral face of the combustible gas generating catalyst chamber and an outer peripheral face of the combustible gas generating catalyst without being interposed between upper end edge portions of the inner peripheral face of the combustible gas generating catalyst chamber and the outer peripheral face of the combustible gas generating catalyst, the upper end edge portions of the inner peripheral face of the combustible gas generating catalyst chamber being brought in close contact with each other such that catalytic reaction heat is radiated from the upper end edge portion of the outer peripheral face of the combustible gas generating catalyst to the upper end edge portion of the inner peripheral face of the combustible gas generating catalyst chamber.

4. The exhaust treatment device of the diesel engine according to claim 2, wherein the combustible gas generating catalyst comprises catalyst supports supporting a catalyst component, the catalyst supports being formed by two parts divided along respective vertical division faces along a central axis of the combustible gas generating catalyst, the liquid fuel retaining member and the guide plate being sandwiched and fixed between the two parts forming the catalyst supports.

5. The exhaust treatment device of the diesel engine according to claim 4, further comprising a heat insulating material interposed between an inner peripheral face of the combustible gas generating catalyst chamber and an outer peripheral face of the combustible gas generating catalyst without being interposed between upper end edge portions of the inner peripheral face of the combustible gas generating catalyst chamber and the outer peripheral face of the combustible gas generating catalyst, the upper end edge portions of the inner peripheral face of the combustible gas generating catalyst chamber being brought in close contact with each other such that catalytic reaction heat is radiated from the upper end edge portion of the outer peripheral face of the combustible gas generating catalyst to the upper end edge portion of the inner peripheral face of the combustible gas generating catalyst chamber.

6. The exhaust treatment device of the diesel engine according to claim 4, wherein the combustible gas generating catalyst further comprises an insertion hole through which the temperature detecting portion of the catalyst temperature detecting device is inserted therein, a central axis of the insertion hole extending orthogonally to the central axis of the combustible gas generating catalyst, along a direction parallel to the division faces, such that the catalyst supports are of the same shape.

7. The exhaust treatment device of the diesel engine according to claim 6, further comprising a heat insulating material interposed between an inner peripheral face of the combustible gas generating catalyst chamber and an outer peripheral face of the combustible gas generating catalyst without being interposed between upper end edge portions of the inner peripheral face of the combustible gas generating catalyst chamber and the outer peripheral face of the combustible gas generating catalyst, the upper end edge portions of the inner peripheral face of the combustible gas generating catalyst chamber being brought in close contact with each other such that catalytic reaction heat is radiated from the upper end edge portion of the outer peripheral face of the combustible gas generating catalyst to the upper end edge portion of the inner peripheral face of the combustible gas generating catalyst chamber.

8. The exhaust treatment device of the diesel engine according to claim 1, further comprising a heat insulating material interposed between an inner peripheral face of the combustible gas generating catalyst chamber and an outer peripheral face of the combustible gas generating catalyst without being interposed between upper end edge portions of the inner peripheral face of the combustible gas generating catalyst chamber and the outer peripheral face of the combustible gas generating catalyst, the upper end edge portions of the inner peripheral face of the combustible gas generating catalyst chamber being brought in close contact with each other such that catalytic reaction heat is radiated from the upper end edge portion of the outer peripheral face of the combustible gas generating catalyst to the upper end edge portion of the inner peripheral face of the combustible gas generating catalyst chamber.

* * * * *